United States Patent [19]

Hodge

[11] 4,063,358

[45] Dec. 20, 1977

[54] GUARD FOR A CHAIN SAW USED FOR CARVING

[76] Inventor: Gerald J. Hodge, 4955 - 24th Ave., Port Huron, Mich. 48060

[21] Appl. No.: 775,744

[22] Filed: Mar. 9, 1977

[51] Int. Cl.[2] ..... B27B 17/02

[52] U.S. Cl. ..... 30/371; 30/382

[58] Field of Search ..... 30/371, 374, 377, 382, 30/381, 383

[56] References Cited

U.S. PATENT DOCUMENTS

| | | | |
|---|---|---|---|
| 2,525,110 | 10/1950 | Adair | 30/371 |
| 2,638,944 | 5/1953 | Woleslagle | 30/371 |

FOREIGN PATENT DOCUMENTS

| | | | |
|---|---|---|---|
| 1,574,058 | 6/1969 | France | 30/382 |

*Primary Examiner*—Jimmy C. Peters

*Attorney, Agent, or Firm*—Harness, Dickey & Pierce

[57] ABSTRACT

A standard chain saw of small construction having a guide bar approximately fourteen inches in length, preferably driven by an electric motor and provided with an adjustable guard which covers substantially all of the chain except for the tip end. The end portion of the chain is used for carving statues and engraving with a sunken design in intaglio.

10 Claims, 5 Drawing Figures

GUARD FOR A CHAIN SAW USED FOR CARVING

BACKGROUND OF THE INVENTION

The chain saw has the chain portion unguarded so as to be available to cut through sizeable trees, logs, limbs and the like. The present chain saw has the chain entirely covered by a guard except for the tip portion which is exposed by shifting a portion of the guard. This provides protection to the operator when cutting with the tip end under complete control and safety.

SUMMARY OF THE INVENTION

A motor is attached to a supporting member to which the guider bar and saw chain are attached. The bail or auxiliary handle is preferably removed and two tubular rectangular elements form the telescoped guard with the outer end portion slidable over the main guard portion. The rear end of the chain saw engages a sprocket which is secured to and driven by the motor shaft. A clutch cover encloses the drive and is provided with three countersunk holes of approximately three-fourth of an inch in depth. The two-piece guard slides over the guide bar and chain until the three holes in the end become aligned with the holes of the clutch cover so that plastic plugs may be put in the holes of the cover for anchoring screws which pass through the aligned holes in the two-piece guard to retain the rear portion in fixed position. Longer screws could be used for supporting the two-piece guard and the clutch cover on the saw but it would be dangerous to use the saw without the guard or cover. A slight opening is provided between the cover and guard to permit the passage of air through the guard during the operation to prevent heating of the chain saw or guide bar.

At the front end of the guide bar an aperture is provided through which a bolt extends which passes through aligned slots on opposite walls of the end section of the guard. A pair of internal bushings on the bolt between the guide bar and walls of the outer guard section permits the end section to be adjusted relative to the tip of the chain upon the main rectangular section and to be secured thereafter in fixed position. A handle is supported on a hand-protecting guard on the bolt which is retained in position by a flange which rides in a slot in the outer guard section so that it may be supported and guided. The amount of saw tip chain exposed at the end is regulated through the loosening of the bolt nut, sliding the outer guard section on the main section and tightening the nut for reclamping the outer guard section in adjusted position. With this arrangement, the saw may be employed in the usual manner for cutting a tree, log and the like and for roughly dressing it to a desired shape. The telescoped guard is secured over the guide bar and chain saw with the front section adjustable to expose a greater or less amount of the chain tip for intaglio cutting and for carving.

DESCRIPTION OF THE PREFERRED EMBODIMENT

Figure 1:
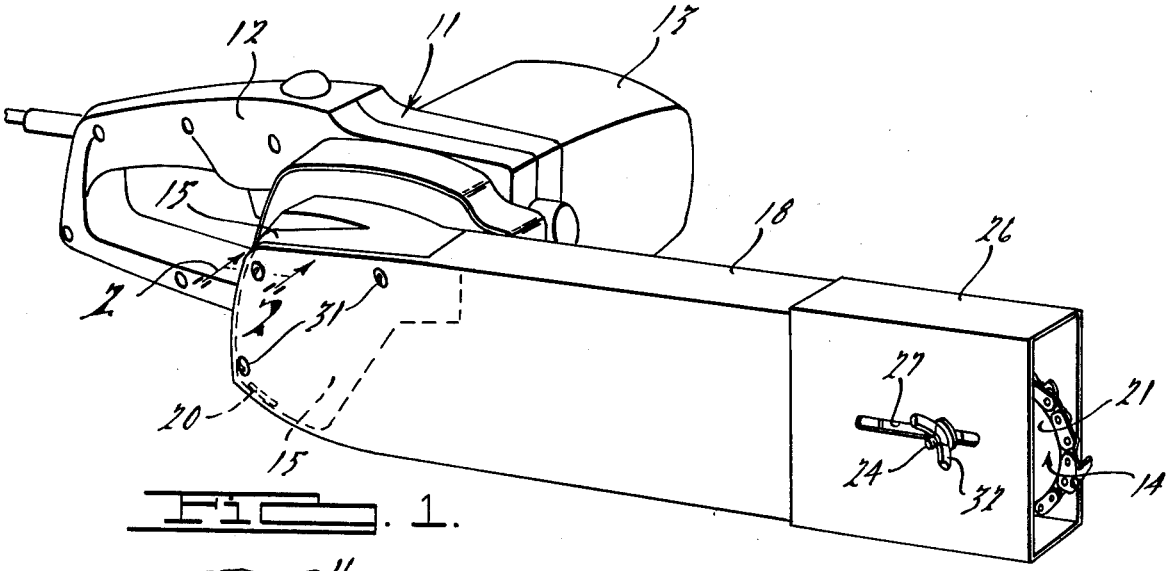
FIG. 1 is a perspective view of a small chain saw driven by an electric motor having a guard on the chain portion embodying features of the present invention.
Figure 2:
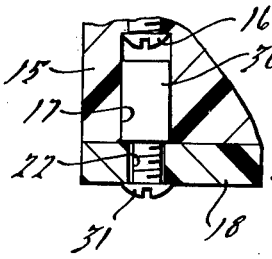
FIG. 2 is a sectional view of the structure illustrated in FIG. 1, taken on the line 2—2 thereof.
Figure 3:
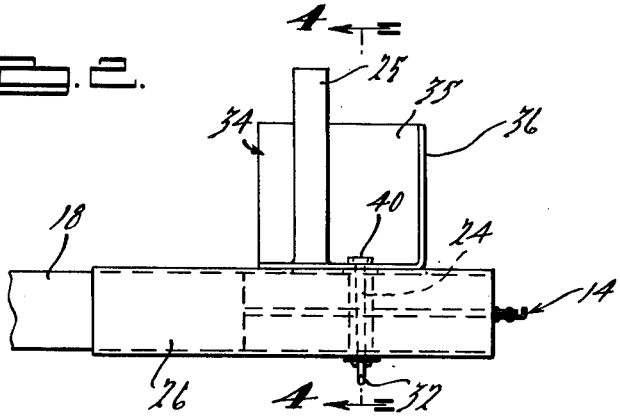
FIG. 3 is a plan view of the adjustable front end section of the guard illustrated in FIG. 1.
Figure 4:
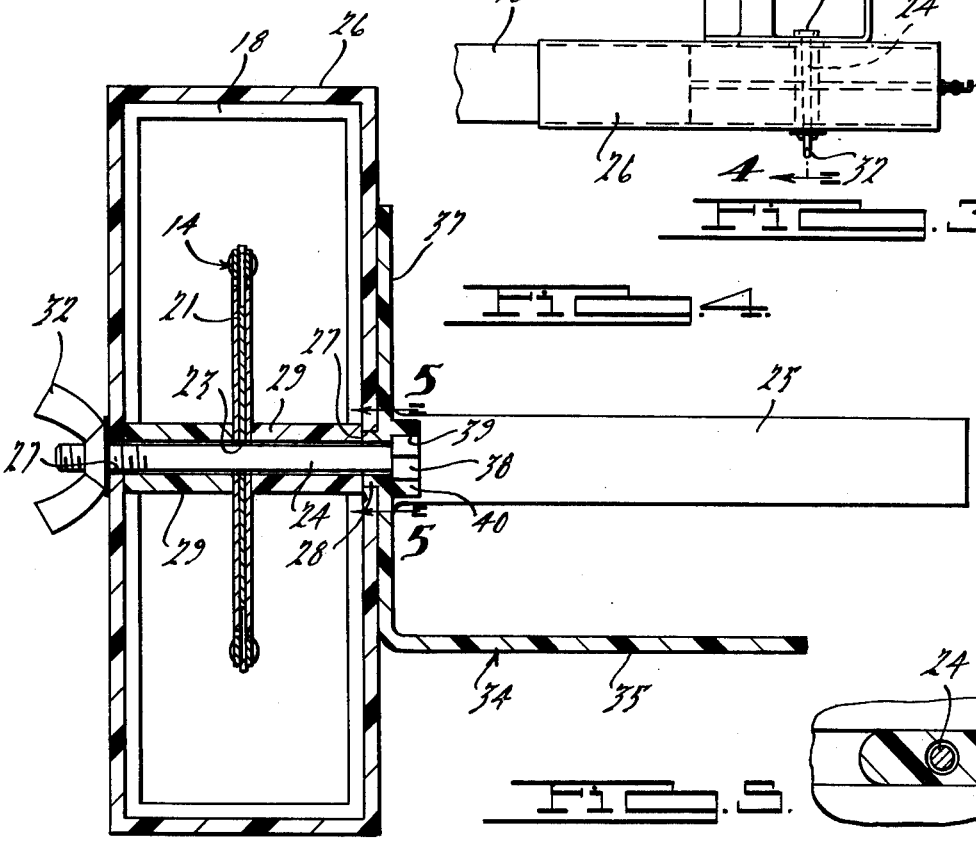
FIG. 4 is a sectional view of the structure illustrated in FIG. 3, taken on the line 4—4 thereof.
Figure 5:
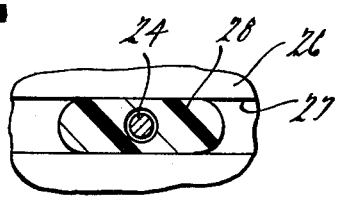
FIG. 5 is a sectional view of the structure illustrated in FIG. 4, taken on the line 5—5 thereof.

Referring to the Figures, a chain saw 11 has a supporting body 12 to which a motor 13 is secured on the rear side and a saw portion 14 on the front side, the portion 12, 13 and 14 being of standard form to which the guard of the present invention is secured. The saw 11 is provided with a clutch cover 15 made of plastic material and is secured to the supporting body by screws 16 which extend into countersunk holes 17 which are approximately three-fourth of an inch in depth after the screw heads are disposed therein.

The present invention pertains to the use of a guard 18 which is one of two telescoped rectangular sections which extends over the chain 19 and guide bar 21 and is secured to the clutch cover 15 leaving an opening 20 at the bottom for a passage for air. The inner end of the guard 18 has three apertures 22 therethrough which align with the three apertures 17 of the clutch cover 15. Plugs 30 three-fourth of an inch in length are provided to extend within the countersunk apertures 17 in which they tightly fit to permit a screw 31 to pass into a central aperture in the plug and those in the guard 18 to firmly secure the guard at the inner end of the chain 19. It is to be understood that the attachment of the guard 18 to the clutch cover 15 will vary depending on the method employed to secure the cover 15 on the saw 11. One or more screws could be removed from the cover 15 and used to hold the cover and guard on the saw or studs could be secured to the cover 15 and used to secure the guard 18 in place thereon.

The outer end of the guide bar 21 has an aperture 23 through which a bolt 24 extends after passing through a hand-protecting guard 34 having a tubular handle 25 supported thereon against the outer guard section 26. The guard section 26 slides over the main guard section 18 to expose the end of the saw 14. The bolt 24 extends through aligned slots 27 through the sides of the end guard section 26 in which a rib 28 on the handle guard 34 extends to slide therein. A pair of bushings 29 are disposed over the bolt 24 either side of the guide bar 21 with the outer ends in engagement with the inner surface of the outer guard section 26 to provide a clamp when a wing nut 32 is tightened on the bolt's projecting thread. The tightening of the wing nut 32 clamps the outer guard section 26 in firm fixed adjusted position. The handle 25 remains stationary along with the bolt and guard 34 which has a bottom web 35 and a pair of upstanding webs 36 and 37. The web 36 is disposed at the front end while the web 37 with the rib 28 on the outer side is disposed against the side of the outer guard 26. The handle 25 provides a handhold for the front end of the chain saw with the hand protected by the webs 35 and 36 from chips and the like. With this arrangement, the web 37 on the inner side of the guard 34 remain stationary with the handle when the outer guard section 26 is adjusted. To prevent the bolt 24 from turning, its head 38 is engaged within a square aperture 39 in a boss 40 projecting outwardly from the web 37 of the hand-protecting guard 34.

When it is decided to carve a complete statue from a seasoned log, it is cut by the chain saw with the guard sections 18 and 26 removed. The log may be further carved to the rough shape of the figure to be produced with all of the bark and excess wood removed. Thereafter, the two guard sections 18 and 26 are secured over the guide bar 21 and the saw chain 14 in position to have the front guide section adjustable to expose the tip of the saw which may be used to cut in intaglio from a fraction to a full two inches in depth under complete control and safety to the operator.

It will be noted that the saw can be moved to have the tip end moved up, down, right or left, in and out during the cutting. This saves substantial time for the removal of background wood for relief cutting and general carving, eliminating a substantial amount of labor required when chisels are employed to roughly shape the wood. Control and safety are obtained by having all of the driven elements of the chain saw entirely enclosed except for the very tip of the chain which has only a small part exposed for producing the carving and cutting in relief.

What is claimed:

1. In a chain saw guard, a support, a motor on one side of said support, a guide bar and chain on the opposite side of said support, a guard embodying a first rectangular element secured to said support for encompassing said guide bar and chain, a second rectangular element supported on the forward end of said first rectangular element, and means for fixedly adjusting said second rectangular element in a fixed position on said first rectangular element to expose a selected amount of the tip portion of the guide bar and chain for carving.

2. In a chain saw guard as recited in claim 1, wherein said support has a clutch cover secured thereto, and means for supporting one end of said first rectangular element on said clutch cover.

3. In a chain saw guard as recited in claim 2, wherein said clutch cover has a plurality of apertures which are countersunk to provide holes of substantial depth, said first rectangular element having apertures aligned with the apertures of said clutch cover, and means for securing said first rectangular element to said clutch cover through said aligned apertures.

4. In a chain saw guard as recited in claim 3, wherein said securing means embodies plugs for the apertures in said clutch cover, each plug having a central aperture, and screws extending through the apertures in the guard and into the apertures of the plugs for securing said guard on said cover.

5. In a chain saw guard as recited in claim 1, wherein the guard embodies two telescoped sections and wherein said guide bar for supporting the chain has an aperture therethrough near the forward end, a bolt through aligned slots in the opposite walls of the outer guard section which permits said outer guard section to be adjusted relative to the guide bar and chain to expose the tip thereof a predetermined amount.

6. In a chain saw guard as recited in claim 5, wherein a handle extends outwardly from a guard through which the bolt extends to provide a protected handhold by which the end of the saw is supported and guided.

7. In a chain saw guard as recited in claim 6, wherein said guard embodies a bottom horizontal web which is joined at the front and side by vertical webs to protect the hand of the operator.

8. In a chain saw guard as recited in claim 5, wherein a pair of bushings is provided on the bolt, one on each side of the guide bar, and a nut on the end of the bolt for clamping the endmost guard section in adjusted position.

9. In a chain saw guard as recited in claim 8, wherein the hand-protecting guard has a flat rib on the inner face which rides within the slot in the adjacent wall of the outer guard section when adjusted relative thereto.

10. In a chain saw guard as recited in claim 5, wherein the guard having the handle has a base with an aperture shaped like the bolt head which extends thereinto to prevent the bolt from turning.

* * * * *